United States Patent [19]

Vineski

[11] Patent Number: 4,650,312

[45] Date of Patent: Mar. 17, 1987

[54] RESIDUAL TONER REMOVAL AND COLLECTION APPARATUS

[75] Inventor: John E. Vineski, Rochester, N.Y.

[73] Assignee: Xerox Corporation, Stamford, Conn.

[21] Appl. No.: 798,661

[22] Filed: Nov. 15, 1985

[51] Int. Cl.[4] ..... G03G 15/21

[52] U.S. Cl. ..... 355/15; 198/670

[58] Field of Search ..... 355/15, 3 DD; 118/652; 430/125; 198/670

[56] References Cited

U.S. PATENT DOCUMENTS 3,927,937 11/1973 de Keyzer ..... 355/15

FOREIGN PATENT DOCUMENTS 58-102269 6/1983 Japan ..... 355/3 DD

*Primary Examiner*—Arthur T. Grimley

*Assistant Examiner*—J. Pendegrass

[57] ABSTRACT

Apparatus for removing toner from a charge-retentive surface and collecting the toner in a receptacle for subsequent disposal thereof. This apparatus is characterized by the provision of structure for minimizing bridging or packing of toner in the flights of an auger forming a part of the removal and collection system as disclosed in the specification. The toner anti-bridging structure provides for imparting vibratory motion directly to the auger. To this end the anti-bridging structure includes a pendulum which is caused to periodically bang into the auger to create vibrations in the auger structure.

2 Claims, 5 Drawing Figures

RESIDUAL TONER REMOVAL AND COLLECTION APPARATUS

BACKGROUND OF THE INVENTION

This invention relates to printing machines, and more particularly, to apparatus for collecting and storing particulate material prior to disposal thereof. The apparatus is especially useful for use with toner particles removed from the charge-retentive surfaces of printing machines such as those employing the well known xerographic imaging process.

In the art of xerography or other similar image reproducing arts, a latent electrostatic image is formed on a charge-retentive surface such as a photoconductor which generally comprises a photoconductive insulating material adhered to a conductive backing. The photoconductor is first provided with a uniform charge after which it is exposed to a light image or an original document to be reproduced. The latent electrostatic images, thus formed, are rendered visible by applying any one of numerous pigmented resins specifically designed for this purpose. In the case of a reusable photoconductive surface, the pigmented resin, more commonly referred to as toner which forms the visible images is transferred to plain paper.

It should be understood that for the purpose of the present invention, which relates to the removal and collection of residual toner particles, the latent electrostatic image may be formed by means other than by the exposure of an electrostatically charged photosensitive member to a light image of an original document. For example, the latent electrostatic image may be generated from imformation electronically stored or generated, and the digital information may be converted to alphanumeric images by image generation electronics and optics. However, such image generation electronic and optic devices form no part of the present invention.

Although a preponderance of the toner forming the images is transferred to the paper during transfer, some residual toner (which also contains debris) remains on the photoconductive surface, it being held thereto by relatively high electrostatic and/or mechanical forces. It is essential for continued optimum operation that the toner remaining on the surface be thoroughly cleaned therefrom.

A commercially successful mode of cleaning employed in automatic xerography utilizes a brush with soft bristles which have suitable triboelectric properties. While the bristles are soft they are sufficiently firm to effect removal of residual toner particles from the charge-retentive surface.

In addition, webs, belts and blades are known to be useful in cleaning such surfaces, blades being one of the most commonly used toner removal devices in the smaller and slower speed machines commercially available today.

Regardless of how the toner particles are removed from the charge-retentive surface they are either recirculated to the developer housing for reuse or discarded. When the toner particles are reused they are first separated from the debris mixed therewith. The present invention, as mentioned above, is directed to apparatus for collecting the residual toner and then discarding it. Typically the toner removed from the surface is augered to either the front or the rear of the machine to be deposited into a receptacle which is used for temporarily storing the particles and for subsequently removing them from the machine.

By far, the most common receptacle utilized for the foregoing purposes is in the form of a bottle into which the toner particles are simply allowed to fall until the bottle is full (i.e. contains all the toner it is capable of handling). This method of collecting the toner particles is somewhat inefficient because the full capacity of the bottle can not be used. This is because the toner first falls to the bottom of the bottle and then builds up in christmas tree fashion until the apex of the tree reaches the mouth of the bottle at the top thereof. As will be appreciated with such an arrangement there are voids between the vertical walls of the bottle and the toner mass forming the christmas tree shape. Thus, all of the bottle capacity is not utilized. Additionally since the packing of the toner in the bottle relies solely on gravity rather than a positive packing method the density to which the toner is packed further diminishes the capacity of toner collection.

Another, less common mode of collecting toner particles, comprises, as shown in U.S. Pat. No. 3,927,937, a storage chamber into which toner particles are moved into the chamber. The chamber forms a part of a cleaning assembly which assembly must be removed in order to discard the particles collected in the chamber without contaminating other parts of the machine in which it is used. While it was most likely intended by the patentee to utilize available space that had not before been possible with prior art devices, such utilization is limited because of the increasing forces required to continue to pile the particles higher and higher above the entrance point for the particles.

Still another apparatus for removing and collecting toner is disclosed in patent application Ser. No. 623,609, filed in the United States Patent and Trademark Office on June 22, 1984. The invention disclosed in the foregoing application is assigned to the same assignee as the invention disclosed herein. As disclosed therein, an auger structure having a single auger segment is employed for conveying toner into a bottle through an opening in a vertical wall thereof. Anti-bridging devices have been found to be necessary in toner removal systems utilizing augers. This is because the toner tends to cake or agglomerate in the pitches or flights of the auger resulting in inefficient handling of the toner. In the absence of anti bridging devices, toner delivery rates in excess of disposal rates, result in bridging in the delivery area. Flow is blocked and the system fails.

Tapping on the side of the toner collecting housing is known to be a viable option to solving the problem of toner caking or packing in the auger. Electromechanical vibrators or solenoids fastened to the toner collector housing function satisfactorily but are too costly.

An apparatus for collecting toner particles and filling a receptacle to capacity with minimal toner bridging is obviously a most desirable invention, particularly if it can be accomplished without appreciably increasing the cost of the removal and collection system.

BRIEF DESCRIPTION OF THE INVENTION

Accordingly, I have provided as disclosed herein a device for collecting toner particles removed from a charge-retentive surface in which the problem of toner bridging has been minimized.

To this end the toner collection apparatus disclosed herein comprises a receptacle in the form of a bottle which is supported in its operative position so that the opening therein is disposed at the side thereof. An auger structure for conveying the residual toner removed from the charge-retentive surface is inserted in the bottle such that the outlet thereof extends into the receptacle a distance equal to approximately ¼ to ½ the length of the receptacle. This distance is chosen such as to optimize the backfilling of the bottle. Backfilling is the filling of a receptacle between the tip of the auger from where the toner exits and the inlet of the receptacle. A portion of a housing encircling the auger forms a channel through which the residual toner is transported. The end of the auger housing opposite that of the auger tip comprises a hopper for receiving residual toner.

In operation, the residual toner falls from the tip of the auger onto the base or floor of the receptacle where it forms a pile until it reaches the tip of the auger. After it reaches this level it is then moved toward the end of the bottle until the resistance to movement in that direction created by the weight of the toner causes it to move in the opposite direction, thus, backfilling the receptacle. It continues to backfill until the resistance becomes greater than the resistance in the other direction whereupon it again moves toward the end of the receptacle. As will be appreciated, the packing density of the toner is increased, over that of the most common prior art receptacle instead of relying on gravity alone for packing of the toner.

In order to minimize bridging in the entrance area and toner loading up or packing in the flights (i.e., areas between the blades of the auger) of the auger there is provided an anti-bridging or packing device. The anti-bridging device of the present invention comprises a pendulum weight which is pivotally attached to a drive pulley. The hub of the drive pulley on the shaft of the auger is disposed within the confines of an open area in the pendulum. A combination of inertial and centrifugal forces causes the pendulum to strike the hub twice per revolution. The shock impulse and vibrations set up in the auger shaft keep the auger flights clear and shake down the toner bridges which tend to build up in the entrance area of the auger structure.

DETAILED DESCRIPTION OF THE PREFERRED EMBODIMENT OF THE INVENTION

Figure 1:
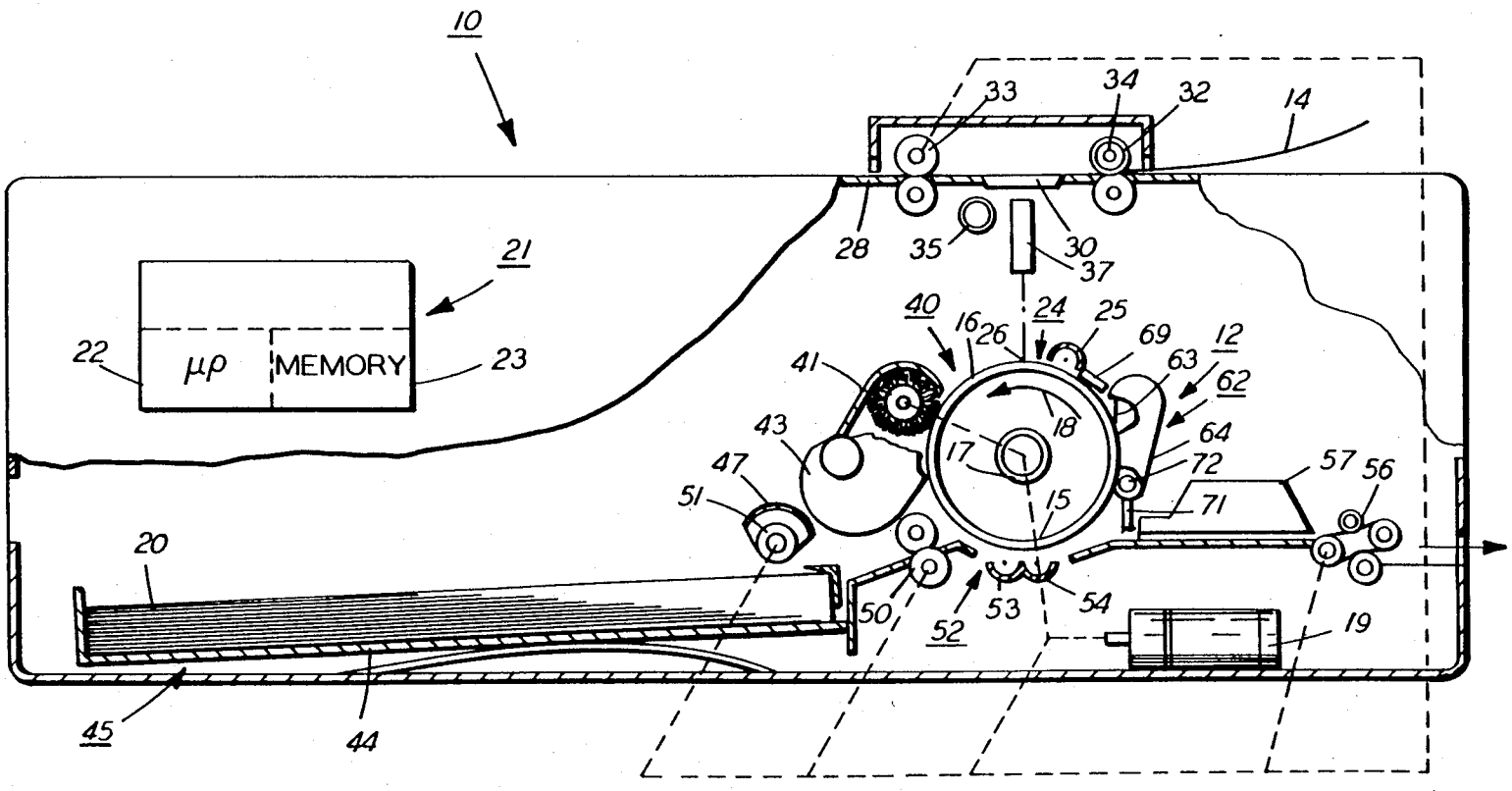
FIG. 1 is a side view depicting a xerographic reproduction machine or printer of the type adapted to incorporate the present invention.

Referring to FIG. 1 of the drawings, there is shown by way of example an automatic xerographic reproduction or printing machine, designated generally by the numeral 10 incorporating a toner removal structure 12 and collection apparatus of the present invention to be discussed hereinafter.

The reproduction machine 10 depicted in FIG. 1 illustrates the various components utilized in machines of this type for producing copies of a document original 14. Although the collection apparatus of the present invention is particularly well adapted for use in reproduction machine 10, it should become evident from the following description that it is equally well suited for use in a wide variety of other reproduction and printing machine types and systems and is not necessarily limited in application to the particular embodiments shown herein.

Reproduction machine 10 has an image recording photoreceptor 15 in the form of a drum, the outer periphery of which has a suitable photoconductive material 16. Photoreceptor 15 is suitably journaled for rotation within the machine frame (not shown) as by means of shaft 17. A main drive motor 19 is drivingly coupled to a photoreceptor 15, motor 19 rotating photoreceptor 15 in the direction indicated by arrow 18 to bring the photoconductive surface 16 of photoreceptor 15 past a series of xerographic processing stations. A suitable controller 21 with microprocessor 22 and memory 23 is provided for operating in predetermined timed relationship the various components that comprise machine 10 to reproduce the document original 14 upon a sheet of final support material such as copy sheet 20. As will be understood by those familiar with the art, memory 23 may comprise suitable read only memory (ROM), random access memory (RAM), and/or non-volatile memory (NVM), memory 23 serving to store the various operating parameters for reproduction machine 10 and the copy run information programmed by the machine user or operator.

Initially, the photoconductive surface 16 of photoreceptor 15 is uniformly charged by a suitable charging device such as scorotron 25 at charging station 24. The uniformly charged photoconductive surface 16 is exposed at exposure station 26 to create a latent electrostatic image of the document original 14 on photoreceptor 15. For this purpose, a suitable supporting surface or platen 28 for document original 14 is provided having a scan aperture or slit 30 therethrough. A suitable document transport, depicted herein as inlet and outlet constant velocity roll pairs 32, 33, is provided for transporting the document original past scan slit 30. Roll pairs 32, 33 are drivingly coupled to main drive motor 19, roll pair 32 being coupled through an electromagnetically operated clutch 34. A suitable document sensor (not shown) is provided at the inlet to platen 28 for sensing the insertion of a document original 14 to be copied and initiating operation of the reproduction machine 10.

A lamp 35, which is disposed below platen 28, serves to illuminate scan slit 30 and the line-like portion of the document original 14 thereover. A suitable fiber optic type lens array 37 which may, for example, comprise an array of gradient index fiber elements, is provided to optically transmit the image ray reflected from the line-like portion of the document original being scanned to the photoconductive surface 16 of photoreceptor 15 at exposure station 26.

Following exposure, the latent image on the photoconductive surface 16 of photoreceptor 15 is developed at a development station 40. There, a suitable developer such as magnetic brush roll 41, which is drivingly coupled to main drive motor 19, brings a suitable developer mix in developer housing 43 into developing relation with the latent image to develop the image and render the same visible.

Copy sheets 20 are supported in stack-like fashion on base 44 of copy sheet supply tray 45. Suitable biasing means are provided to raise base 44 of tray 45 and bring the topmost copy sheet 20 in the stack of sheets 20 into operative relationship with segmented feed rolls 47. Feed rolls 47 are driven by main drive motor 19 through an electromagnetically operated clutch 51.

Rolls 49 serve upon actuation of clutch 51 to feed the topmost copy sheet forward into the nip of a registration roll pair 50 which register the copy sheet with the image on the photoconductive surface 16 of photoreceptor 15. Registration roll pair 50 advance the copy sheet to transfer station 52. There, suitable transfer/detack means such as transfer/detack corotrons 53, 54 bring the copy sheet into transfer relation with the developed image on photoconductive surface 16 and separate the copy sheet therefrom for fixing and discharge as a finished copy.

Following transfer station 52, the image bearing copy sheet is transported to fuser 57, which may, for example, comprise heat and pressure type fusing, the finished copy is transported by roll pair 56 to a suitable receptacle such as an output tray (not shown). Registration roll pair 50 and transport roll pair 56 are driven by main drive motor 19 through suitable driving means such as belts and pulleys.

Following transfer, residual toner remaining on the photoconductive surface 16 of photoreceptor 15 is removed at cleaning station 62 by means of cleaning blade 63 (FIG. 1) forming a part of the toner removal apparatus 12. Toner removed by blade 63 is deposited into a suitable collector 64 for removal.

While a drum-type photoreceptor is shown and described herein, it will be understood that other photoreceptor types may be employed such as belt, web, etc.

To permit effective and controlled charging of the photoconductive surface 16 by scorotron 25 to a predetermined level necessitates that any residual charges on the photoconductive surface 16 or trapped in the photoreceptor be removed prior to charging. An erase device 69 is provided for this purpose.

At the cleaning station 62, the cleaning blade 63 is supported in contact with the photoreceptor 15 such that residual toner is chiselled therefrom.

Figure 2:
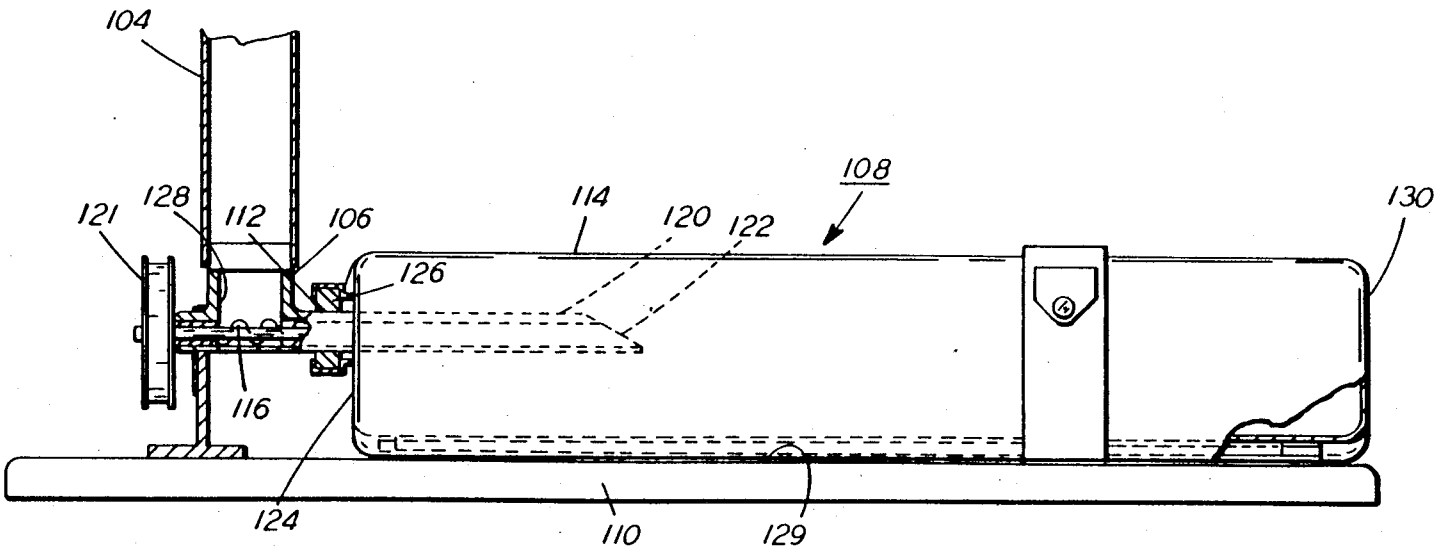
FIG. 2 is a perspective view of a toner collection apparatus representing the present invention.

The toner and debris that are removed from the receptor 15 fall into the collector 64 and are transported by means of an auger 72 disposed in the bottom of the collector 64. It is moved toward the back of the machine where it falls through an opening in the bottom of the collector 64. The residual toner and debris fall downwardly via conduit 71 of FIG. 1 or 104 of FIG. 2. From the conduit, the residual toner is directed downwardly into one end of an auger housing 106 after which it is conveyed into a receptacle 108 which serves to store the residual toner until the receptacle is full after which it is removed.

The receptacle 108 which is herein disclosed as a bottle is supported in its operative position by a machine frame member 110 so that an opening 112 therein is disposed at the side thereof adjacent a top wall 114 of the receptacle. An auger 116 disposed in the auger housing 106 is provided for moving the residual toner that is delivered to the auger housing from conduit 104, the conduit communicating with one end of the auger housing. The auger 116 is provided with a pulley 121 which is operatively coupled to the machine drive (not shown) for imparting rotary motion thereto. Portion 120 of the auger housing encircles a part of the auger and together with that part of the auger is installed in the bottle such that an outlet or tip 122 thereof extends into the receptacle a distance equal to approximately ¼ to ½ the length of the receptacle. This distance is chosen such as to optimize the backfilling of the bottle. Backfilling is the filling of the receptacle between the tip of the auger from where the toner exits and the inlet of the receptacle which is formed integrally with the vertical wall 124 of the receptacle. The portion of the housing encircling the auger forms a channel through which the residual toner is transported. To prevent residual toner from spilling out of the bottle through the opening 112 there is provided a foam seal 126 in the outlet. The end of the auger housing opposite the tip 122 comprises a hopper 128 for receiving residual toner from the conduit 104.

In operation, the residual toner falls from the tip 122 of the auger onto the base or floor of the receptacle where it forms a pile until it reaches the tip of the auger. After it reaches this level, it is then moved toward a vertical wall 130 of the bottle until the resistance to movement in that direction created by the weight of the toner causes it to move in the opposite direction, i.e., in the direction of the vertical wall 124 thus causing backfilling of the receptacle. It continues to cause backfilling until the resistance becomes greater than in the other direction whereupon it again moves in the direction of the vertical wall 130. As will be appreciated, the packing density using the foregoing structure of the toner is increased over that of the most common prior art devices due to the use of the positive force in moving the toner into the receptacle instead of relying on gravity alone for packing of the toner.

Figure 3:
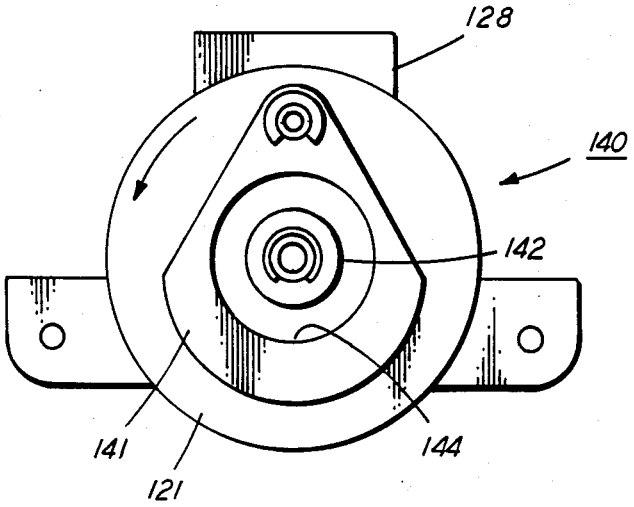
FIGS. 3, 3A and 4 are fragmentary views of FIG. 2 illustrating an anti-bridging device forming a part of the toner collection apparatus.
Figure 3A:
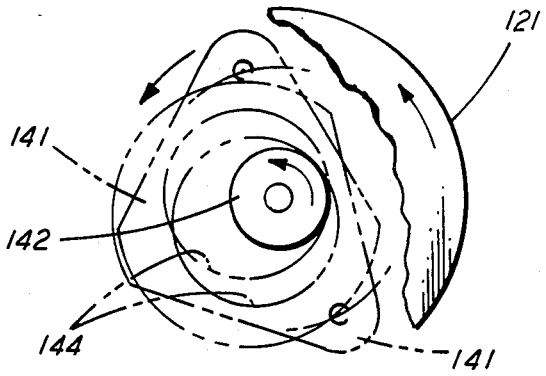
Figure 4:
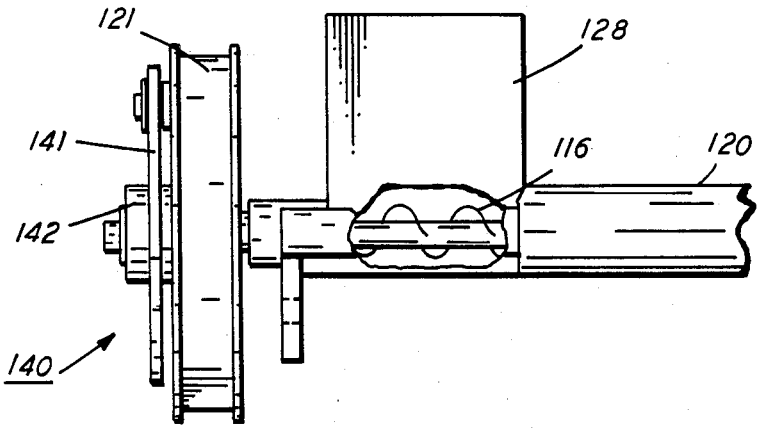

In order to minimize toner loading up or packing in the flights (i.e. areas between the blades of the auger) of the auger there is provided an anti-bridging structure or device generally indicated by the reference character 140 of FIGS. 3, 3A and 4. As shown therein, the anti-bridging device of the present invention comprises a pendulum weight 141 which is pivotally attached to the pulley 121. The pendulum weight 141 has an open central area 144 disposed around the hub 142 of the auger drive pully 121. As the drive pulley 121 is rotated the pendulum weight falls and strikes the pulley hub twice per revolution. FIG. 3A shows the motions of the pendulum weight at low rotational speeds. As the rotational speed to an operational speed of 50 to 140 RPM additional inertial forces increase the impact on the central hub. The vibrations set up in the auger shaft keeps the auger flights clear and shakes down the toner bridges which tend to build up in the entrance area of the auger structure.

What is claimed is:

1. Apparatus for removing toner from a charge-retentive surface and collecting it for subsequent removal, said apparatus comprising:

blade means for removing residual toner from said charge-retentive surface;

a receptacle for collecting said residual toner;

means for conveying said residual toner from where it is removed from said charge-retentive surface into said receptacle; said conveying means comprising conduit means and auger means; and means for imparting vibratory motion in said auger means by direct contact therewith whereby toner bridging in said auger is minimized, said means for imparting vibratory motion comprising a pendulum which is caused to periodically bang into said auger means, said pendulum being carried by a pulley having a hub attached to the shaft of said auger.

2. Apparatus according to claim 1 wherein said pendulum comprises an opening through which said pulley hub protrudes.

* * * * *